US006034308A

United States Patent [19]

Little

[11] Patent Number: 6,034,308

[45] Date of Patent: Mar. 7, 2000

[54] ERGONOMIC STRING INSTRUMENT

[75] Inventor: Jerome B. Little, Leeds, Mass.

[73] Assignee: Hampshire College, Amherst, Mass.

[21] Appl. No.: 08/800,594

[22] Filed: Feb. 18, 1997

[51] Int. Cl.[7] ..... G10D 3/00

[52] U.S. Cl. ..... 84/291; 84/293; 84/267

[58] Field of Search ..... 84/291, 293, 267

[56] References Cited

U.S. PATENT DOCUMENTS

| | | | |
|---|---|---|---|
| 2,816,469 | 12/1957 | Gossom | 84/293 |
| 3,398,622 | 8/1968 | Smith | 84/293 |
| 3,739,072 | 6/1973 | Smith | 84/267 |
| 4,534,260 | 8/1985 | Burrell | 84/293 |
| 4,890,530 | 1/1990 | Tatsumi | 84/291 |
| 5,445,058 | 8/1995 | Hoke, Jr. | 84/293 |
| 5,616,873 | 4/1997 | Fishman et al. | 84/293 |

*Primary Examiner*—Robert E. Nappi
*Assistant Examiner*—Kim Lockett
*Attorney, Agent, or Firm*—Deborah A. Basile

[57] ABSTRACT

The invention is an ergonomically constructed string instrument which is achieved by rotating both the nut and the bridge about a longitudinal axis in the direction from which the player's hand approaches, to the degree which is predetermined to accommodate a particular player. The invention addresses the high incidence of overuse or repetitive strain injuries suffered by players due to extreme wrist flexion.

1 Claim, 6 Drawing Sheets

ERGONOMIC STRING INSTRUMENT

BACKGROUND OF THE INVENTION

1. Field of the Invention

The invention relates generally to a stringed musical instrument which is designed to address medical problems particular to electric bass players or to players of a six string guitar. The design of the instrument increases the efficiency of the muscular tendon system of the hands, wrists and arms, thereby reducing for the player, the risk of developing the many overuse or repetitive strain injuries to which guitar and bass players are prone. In short, the invention makes the playing positions, both chording and plucking, more comfortable.

Playing a musical instrument requires a high degree of dexterity and finely controlled, repetitive, often rapid movements by particular parts of the body, primarily the upper extremities. Frequently, such movements are required over extended periods of time. Even small errors in the biomechanical systems of the upper extremities can have disastrous effects on one's ability to perform on his or her instrument, some to the point of threatening or ending careers. Playing related disorders are extremely prevalent in the United States. Most musicians who suffer from playing related problems suffer from some form of overuse syndrome which is defined as the damage that occurs when the tissue is stressed beyond its anatomical or physiological limits, whether acutely or chronically. Overuse syndrome is frequently used synonymously with the term repetitive strain injury. Examples of playing related disorders suffered by musicians are: tendonitis and tenosynovitis, myofascial pain, tension myalgia, fibromyalgia, fibrositis or a nerve entrapment syndrome such as carpal tunnel syndrome. In addition, musicians suffer from disorders which may stem from the central nervous system often referred to as an occupational craft palsy such as occupational neurosis or involuntary cramping of the hand.

Guitar and bass players comprise a group that are at a relatively high risk of developing playing related injuries. In most instances, the injuries are due to the hand, wrist and arm positions required to play the instrument. The standard bass guitar has a scale length of 34 inches. This is a distance that the string travels from the contact or "witness point" at the bridge to the contact at the nut, and is compared to a scale length of 24 to 26 inches on a standard six-string guitar. Due to the growing popularity of five and six-string basses as opposed to the standard four-string, which have an extra string in the low register, many basses are being made with a 35 or sometimes even 36 inch scale length. The reason for this is to create added tension on the heavier gauge string so that notes may ring truer. What this means, however, is that the neck of the bass is very long compared to the guitar, requiring a long reach of the bassist.

In the course of describing the relative positions of the upper limbs when playing the bass guitar, a "right-handed" style will be assumed. The left hand refers to the hand which depresses the string to the fingerboard, and the right hand refers to the hand which plucks or strums or in some way sets the strings into vibration. The bass is played in a similar way to the guitar, either sitting or standing and, if standing, supported by a shoulder strap. With the instrument held more or less horizontally, the left hand comes from underneath and behind the neck of the instrument and the fingers curl around the neck to depress the strings against the fingerboard. The thumb is placed either flat on the back of the neck or curled around the top of the neck, usually the former. The most efficient and most advocated technique for the left hand is to use the tips of the fingers to depress the strings.

The right hand comes over the top of the instrument and assumes the position for plucking or strumming the strings. This position constitutes the major difference between playing guitar and bass. The guitar is usually played with a pick or with the fingers, either strumming across the strings or plucking individual strings. While the bass can also be played either with a pick or percussively with the side of the thumb, it is generally played using the fingertips.

The first principal for correct technique at any instrument or indeed in any repetitive activity is economy of motion. Only those motions directly related to the task should be employed. For bass players in order for the right hand and fingers to be in a position for good technique, and the right arm to be relaxed in order to prevent unnecessary muscular activity, the wrist is prone to extreme degrees of flexion. Wrist flexion, coupled with the repetitive and fairly substantial muscular demands of the fingers, places the bass player at a high risk of developing overuse syndrome, particularly tendonitis, tenosynovitis and carpal tunnel syndrome. The more a guitarist is able to reduce this hyper-flexed position toward a neutral wrist position, the less vulnerable the musician appears to be to suffer hand, wrist and arm problems.

The present invention addresses a solution to the problem of overuse injury by bass players.

2. Invention Disclosure Statement

Currently, only one design of a musical string instrument addresses in a very limited way the comfort of the player. One known design which is the subject of a patent granted to Leo L. Burrell (U.S. Pat. No. 4, 534,260) aligns the assembly of the bridge and nut of the musical instrument in such a way that chording finger positions are comfortable. This is achieved by Burrell by rotating the nut relative to the bridge.

The present invention is a significant advance or improvement over Burrell in that ergonomic function is accomplished by rotating both the nut and the bridge about a central longitudinal axis, each rotated in the direction from which the player's hand approaches, and each one set at angles relative to the plane of the instrument body. This is done because the body contacts the player and therefore defines the angles in relationship to the rest of the instrument relative to the player. The chording hand approaches the neck and strings from underneath, therefore, the nut is rotated downward, reducing the amount of wrist flexion required for normal technique. Similarly, the plucking hand approaches the strings from above so the bridge is rotated upward, also reducing unwanted wrist flexion. The result of these rotations is an instrument neck containing a compound twist. Also, the present invention comprises a fingerboard which contains a compound radius, with a smaller radius at the nut and a larger radius at the body end. The fingerboard is also tapered in the present invention to cause greater string spacing at the bridge than at the nut.

BRIEF SUMMARY OF THE INVENTION

It is an object of the present invention to provide a solution to the high risk of overuse injuries suffered by guitar and bass players.

A further goal of the invention is to be capable of making an instrument with bridge and nut each set at custom angles to suit the needs of the individual musician. A further aim of the present invention is to personalize the instrument by actually measuring the player and determining the optimum degree of rotation to fit the particular player. The invention would be appropriate for active or professional musicians, as well as new players.

It is an object of the present invention to have the bridge and nut rotated in opposite directions by a central longitudinal axis, set at angles relative to the instrument body to create more comfortable playing positions for both left and right hands, wrists, and arms.

It is another aim of the present invention to have a fingerboard which contains a compound radius, with a smaller radius at the nut and a larger radius at the body end. It is a further object of the present invention to have a convex fingerboard which is tapered with greater string spacing at the bridge than at the nut.

It is a further object of the invention in wood construction to have a neck which is laminated, with laminations parallel with the fingerboard and a neck structure which runs the entire length of the instrument, through the body.

It is a further object of the invention to have a neck which contains one or two double acting adjustable truss rods which are adjusted from either the nut end, the body end or under the fingerboard of the neck.

It is a further object of the present invention to have a body top which contains no distinctive plane: The neck is raised through the body and "body wings" are carved and rounded convexly.

It is a further aim of the present invention to have a body back which contains concave surfaces to conform to the player's body which also reduces the weight of the instrument.

Briefly stated, the present invention teaches a musical stringed instrument which is designed so as to create the optimal relationship between the plane of the strings and the hands of the player. The plane of the strings should be rotated in the direction in which the hand approaches it. Since the left hand comes from behind and underneath the neck and the right hand comes over the top of the body (and also the plane of the strings), the neck would ideally be rotated downward in relation to the plane of the instrument body. Likewise, the bridge (and thus the plane of the strings) would be rotated upward at the body end. The result of this idealized plane would essentially be a twisted guitar neck.

DETAILED DESCRIPTION OF THE PREFERRED EMBODIMENT

Figure 1:
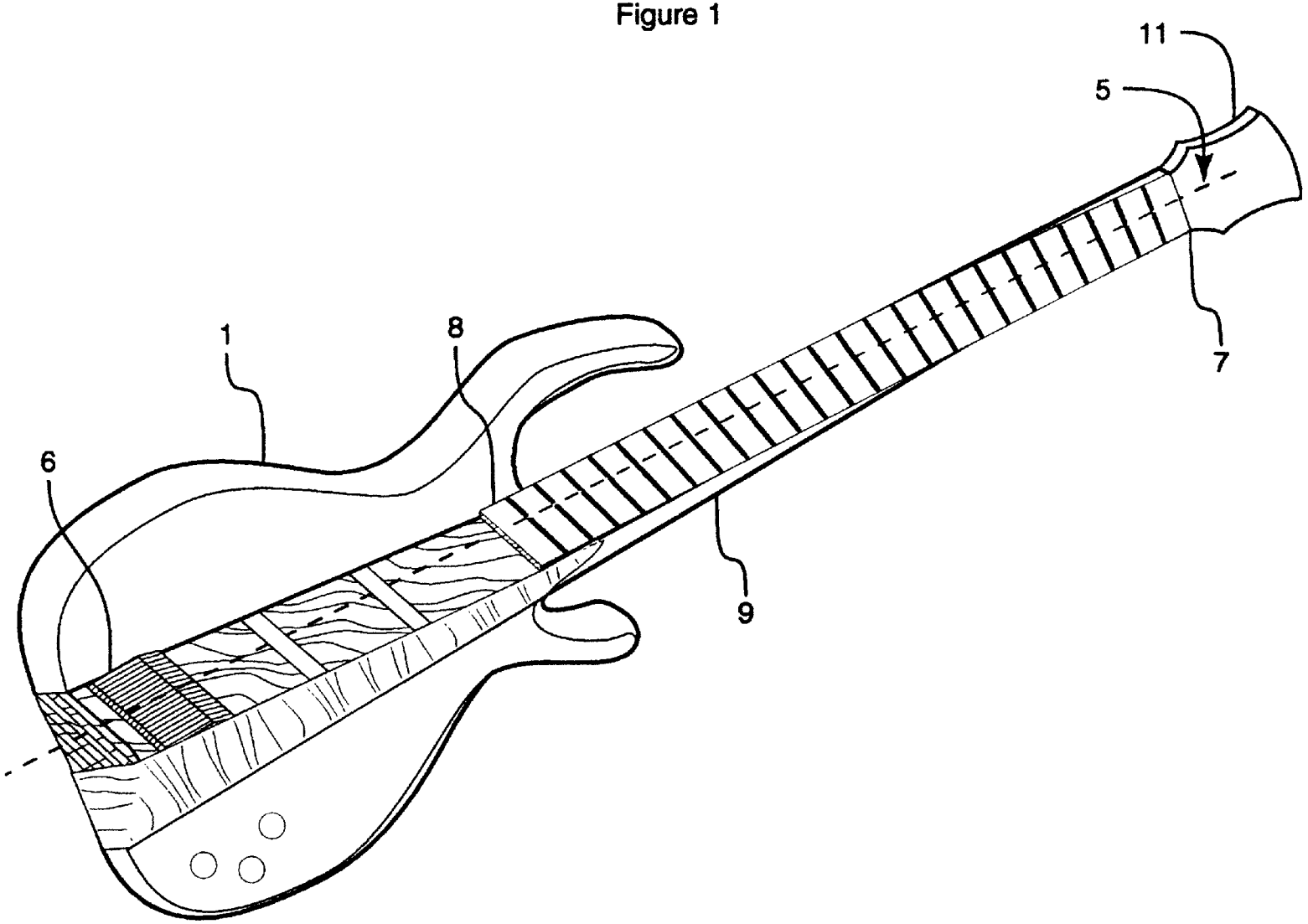
FIG. 1: Depicts a three-dimensional view of the instrument showing the rotated bridge and nut and the central axis.
Figure 2:
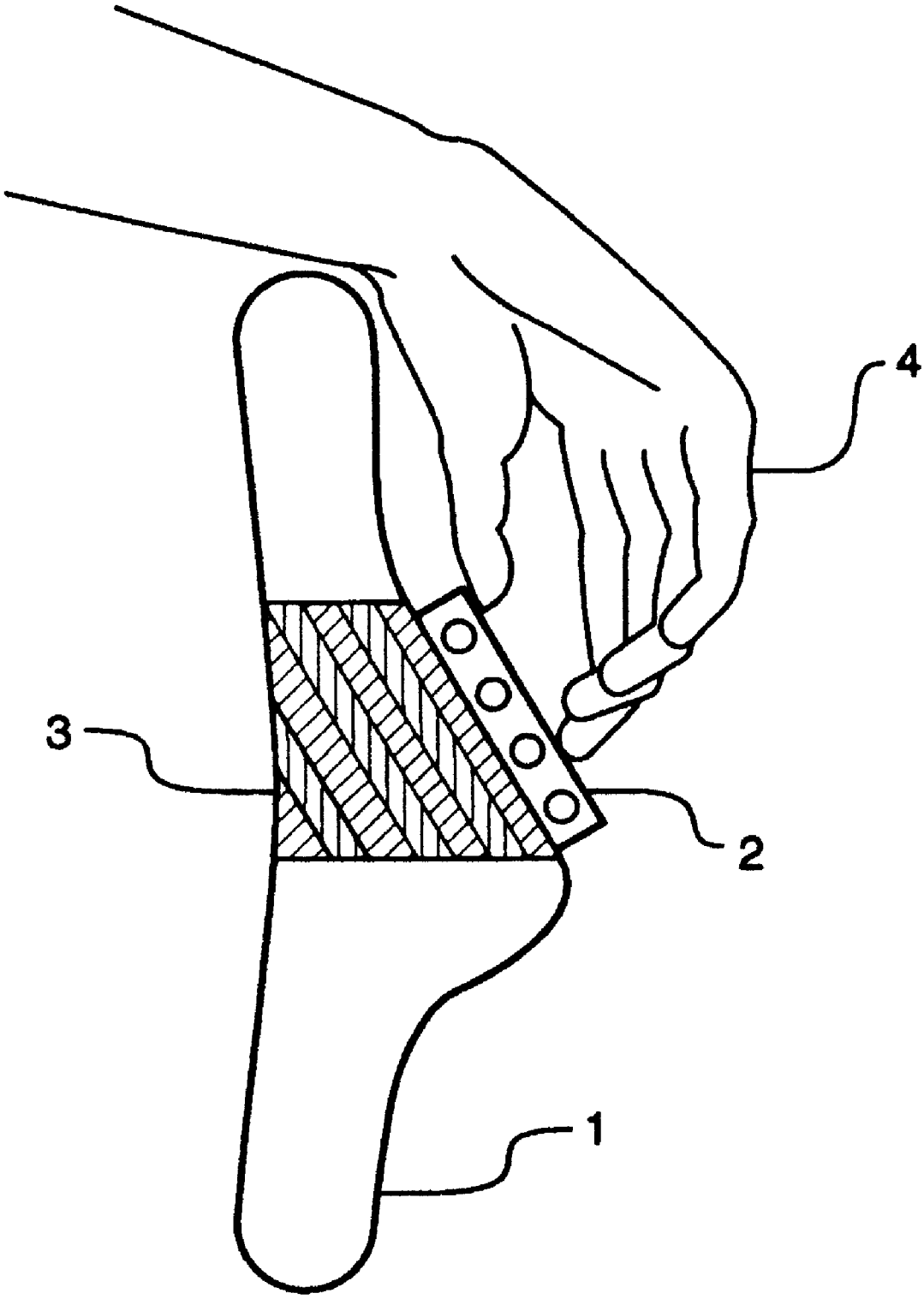
FIG. 2: Depicts an end view of the invention from the body end and illustrates the rotation of the bridge, the player's wrist position, the concave back of the body of the instrument and the lack of a distinctive plane.
Figure 3:
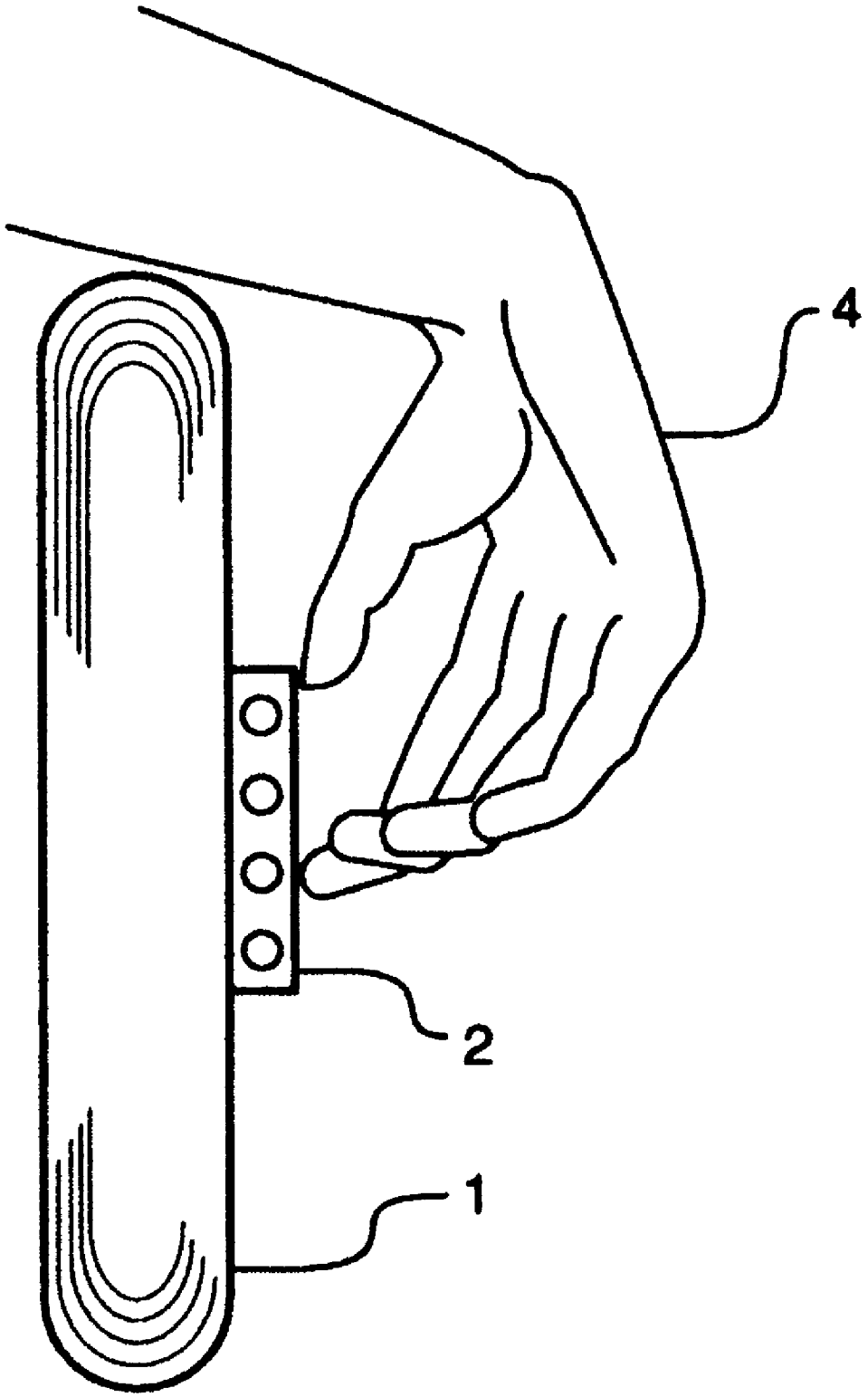
FIG. 3: Depicts an end view of a typical stringed instrument from the body end and illustrates the strained and uncomfortable wrist position required to play the instrument.

Referring to FIG. 1, the preferred embodiment of the invention consists of a string instrument constructed of any suitable material having a body and a neck 9. The neck has a fingerboard 7, wich includes a bridge end 6 and a nut end 7. The neck is twisted in opposite directions along the longitudinal axis 5 to accommodate the comfort of a player. For example, FIG. 2 shows the bridge end 2 which is rotated upward and the unt end 7 which is rotated downward to decrease the degree of flexion required by the player's hand and wrist 4. The body 1 back surface is concave 3 to accommodate the player's body. FIG. 3 shows a side view of a typical string musical instrument without a rotated bridge. As shown, both the front surface and the back surface are flat. This type of an arrangement necessitates a greater degree of flexion by the player's wrist resulting in injury to the player. A side view of the string musical instrument of the present invention is shown in FIG. 2. The bridge is rotated towards the player's chording hand, typically upwards, to provide more comfort. In addition, the front surface has a convex upper surface to provide enhanced ease and comfort to a player. Not only is the bridge rotated upwards, but the nut is also rotated towards the player's chording hand to provide more comfortable access.

Figure 4:
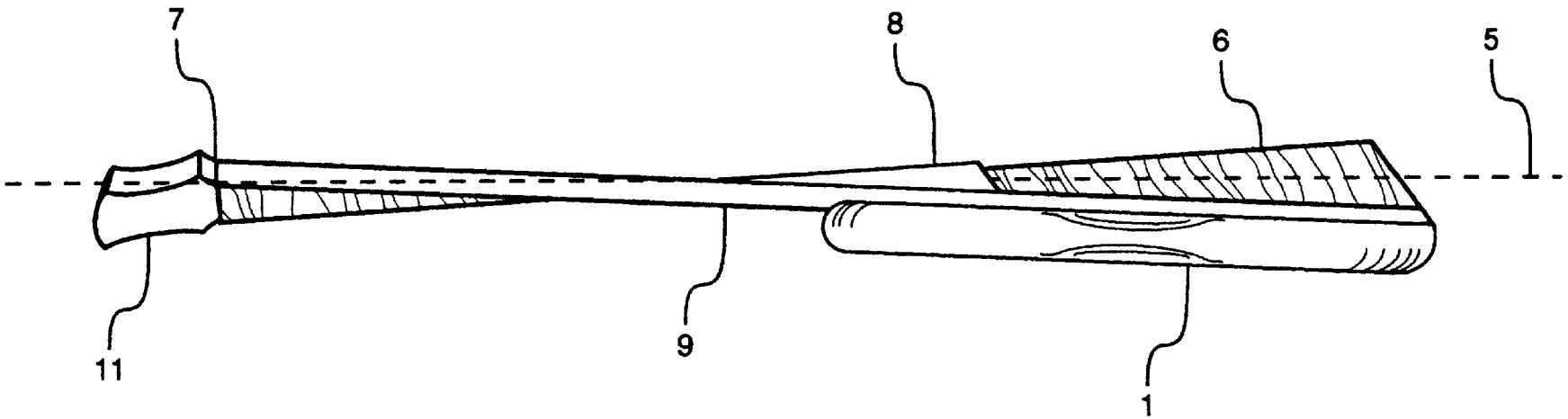
FIG.4: Depicts a side view of the invention showing the twist and the central longitudinal axis.

Referring generally to FIG. 4, the range of rotation along the longitudinal axis 5 will be, for example, 5 to 65 degrees total. It is not necessary to rotate both the nut end 7 and the bridge end 6 to the same degree. Some players may not want both aspects of the nut and the bridge rotated equally in which case one may be rotated to a greater degree than the other. The fingerboard 8 is convex and is arched more at the nut end 7 to facilitate bending notes which means pulling or pushing the strings across the fingerboard 8. The arch allows the player to push or pull without interfering with frets further up the neck 9. This would require that the fingerboard 8 be more arched at the nut end 7 and less arched at the bridge end 6. The width of the fingerboard 8 is variable with greater string spacing at the bridge end 6 than at the nut end 7. The neck structure 9 runs the entire length of the instrument. The benefit to that is to keep continuity of the twist and to add character to the sound. There is no mechanical joint in the construction.

Figure 5:
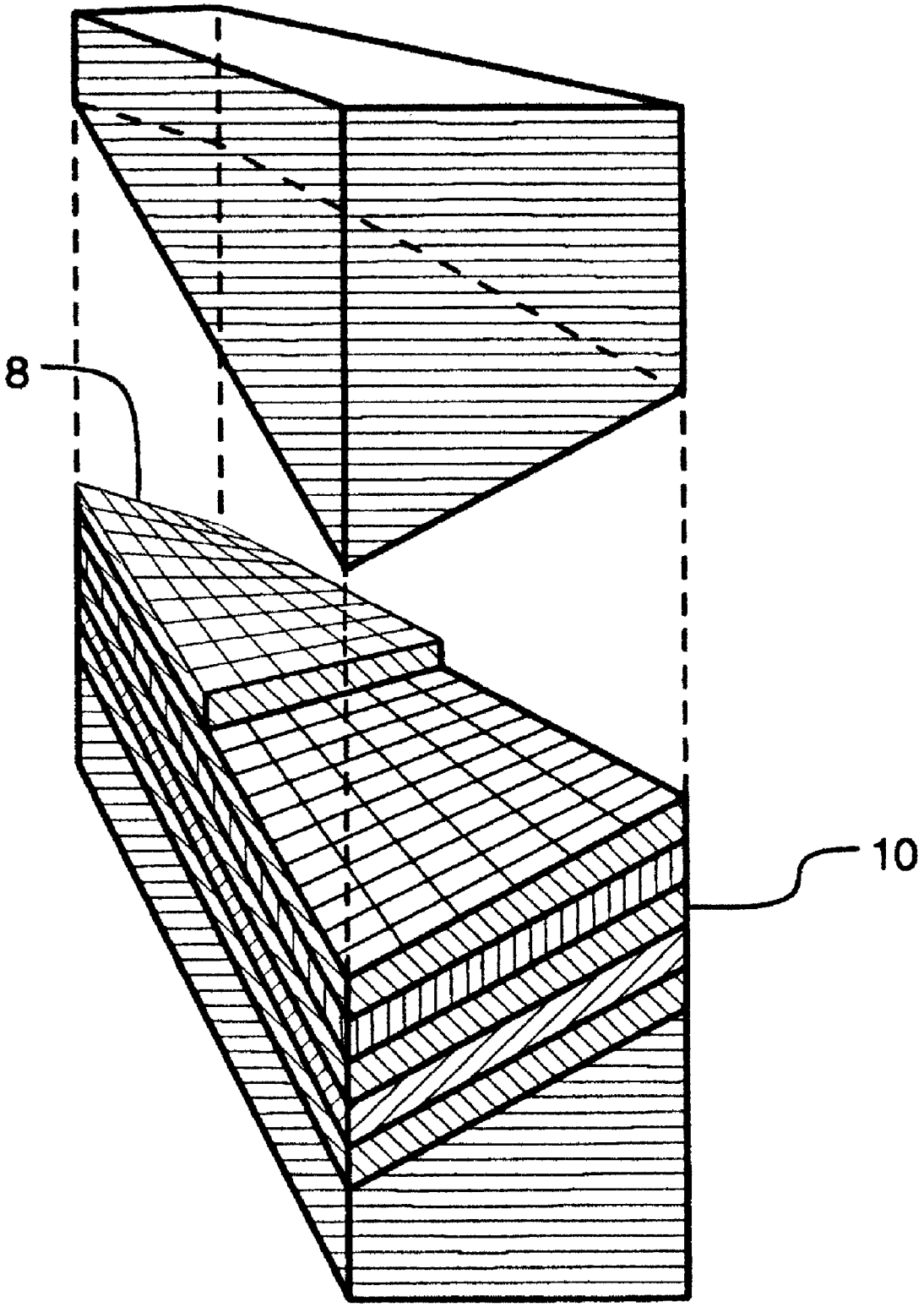
FIG. 5: Depicts the laminating process; the laminates being pressed and glued in the forms.
Figure 6:
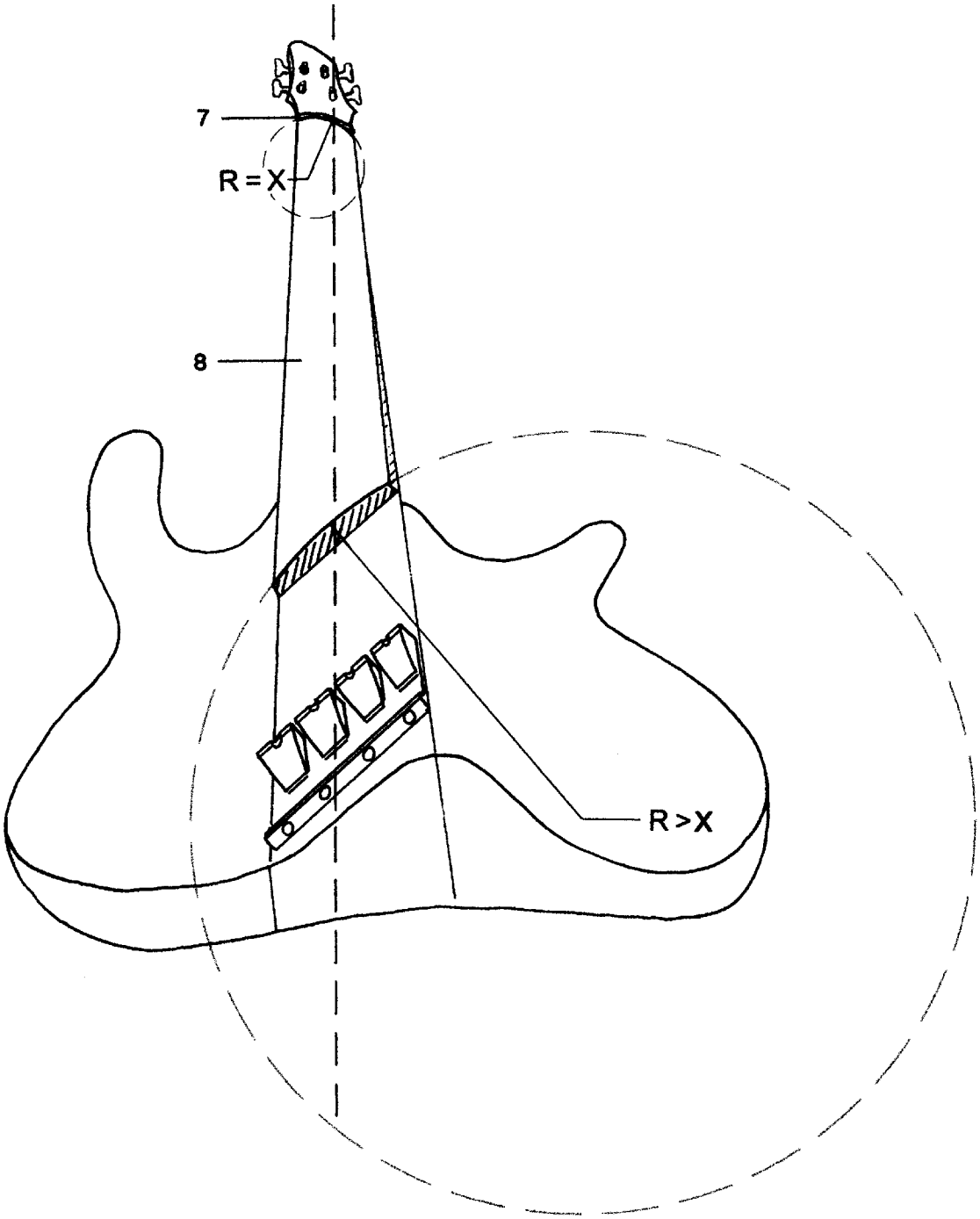
FIG. 6: Depicts the convex nature of the fingerboard.

As shown in FIG. 5, in wood construction, the neck is constructed of laminates 10 allowing for more stability and strength. One or two truss rods (steel rods) run the length of the neck under the fingerboard 8. These truss rods are double acting which means they can turn either way, providing the ability to adjust the bow of the neck to achieve the correct amount of "relief" and to counteract the tension of the strings. "Relief" is known as the slight bowing of the neck which mimics the shape of the open strings when vibrating and allows them the space to vibrate. The laminate construction increases the strength of the instrument and therefore its stability, durability and lifetime. The laminates are twisted and they run the long way along the neck.

As shown in FIG. 1, the fingerboard 8 of the invention (as well as its cross section) continually changes throughout its length. The width of the fingerboard 8 progressively increases as it is measured from the nut end 7 to the bridge end 6. Similarly, the curvature of the top portion, causing its convex nature, also called the radius or camber, progressively decreases as it is measured from the nut to its body end. This continually changing curvature of the top portion of the fingerboard is an important feature of the invention for it allows the strings to be pushed or pulled for the purpose of bending pitches, while maintaining low action, which is the relationship (height) of the strings over the fretboard, without the strings hitting frets higher up the neck and thus deadening the notes ("fretting out"). This is particularly important with this design because without this feature the twist in the neck limits the amount of string travel in the pulling direction.

In wood construction, the instrument neck is made up of many wood laminates, each from 3/33 of an inch to ¼ of an inch thick. They are laminated parallel with the fingerboard (as opposed to perpendicular thereto) and they are pressed and glued together in a set of forms which are milled to the desired curve, or twist. The laminates which make up the neck run the entire length of the instrument, through the body, eliminating any mechanical joint between neck and body, and also continuing to curve throughout the length of the instrument, from bridge to nut and onto the tip of the headstock 11 (the portion of the neck which supports the tuning pegs). The headstock 11 actually contains a similar twist of the rest of the neck, although its plane is angled back 8° to 12° from the plane of the neck.

The reason the invention uses laminates in wood construction as opposed to shaping the neck out of a solid block of wood is to create added strength and stability. If the neck were to be shaped from a solid block of wood, the shaping would cut across the wood fibers exposing end grain and generally weakening the structure. This structure must carry over 200 pounds of string tension, and it must hold its position with high tolerance through changes and temperature and humidity (to which wood reacts very easily). Furthermore, the more stable the neck is, the less acoustic energy is lost through dampening and excessive sympathetic vibrations, producing a richer sound spectrum (more fundamental content and more harmonics) and a longer sustained time.

The curve required for the neck of this instrument is quite complex due to the fact that in addition to the twist, the neck must be tapered; its width is greater at the bridge than at the nut. Furthermore, it must be such that it consists of a series of straight lines, both longitudinally and perpendicular to the twist so that for each string running from nut to bridge there is equal spacing along their entire length from the string to the fretboard (the "action" must be equal). The fretboard must contain straight lines corresponding with each string location.

The present invention is designed for a playing style common to electric bassists which physiologically are significantly different from the playing style of guitarists. In other words, bassists tend to pluck the strings with the tips of their fingers, their hands being held perpendicular to the longitudinal axis of the strings, whereas guitarists usually either use a pick or strum the strings and therefore maintain different hand positions from that of the electric bassist. The resulting difference in design is that the present invention features a significant rotation of the bridge and therefore the point at which the strings are cross-sectionally parallel with the face of the body is somewhere in the middle of the neck, closer to the nut, and not over the body at all.

Having described the preferred embodiments of the invention with reference to the accompanying drawings, it is to be understood that the invention is not limited to these precise embodiments and that various changes and modifications may be affected therein by one skilled in the art without departing from the scope or spirit of the invention as defined in the appended claims.

I claim:

1. A string musical instrument comprising:

a body and a neck, said neck running along the entire length of said musical instrument, said neck having a fingerboard, said fingerboard having a longitudinal axis and including a bridge end and nut end, said bridge end and nut end both being rotated or twisted about said longitudinal axis in opposite directions to each other said fingerboard having a plurality of strings extending from said nut and to said bridge end and said strings being spaced closer together at said nut and than at said bridge end whereby chording and plucking positions are made more comfortable and wherein said bridge end and nut end rotate or twist about said longitudinal axis in the range of 5° to 65° depending upon the particular needs of the player of the instrument and wherein said neck is made of a plurality of wood laminates each said laminate extending along the entire length of said string musical instrument, each said laminate being shaped to rotate about said longitudinal axis from said bridge end to said nut end in opposite directions, said laminates being fastened together to form an overall desired rotation.

* * * * *